US007882578B2

(12) United States Patent
Li et al.

(10) Patent No.: US 7,882,578 B2
(45) Date of Patent: Feb. 8, 2011

(54) POP-UP VALVE WITH SEAL

(75) Inventors: Keping Li, Xiamen (CN); Pingsheng Yao, Xiamen (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 915 days.

(21) Appl. No.: 11/141,887

(22) Filed: Jun. 1, 2005

(65) Prior Publication Data

US 2006/0273278 A1 Dec. 7, 2006

(51) Int. Cl.
*E03C 1/23* (2006.01)

(52) U.S. Cl. ..... 4/689; 4/696

(58) Field of Classification Search ..... 4/288, 4/650, 685, 689–692, 696; 285/4, 8, 10, 285/23, 32, 34, 46, 58, 134.1, 179, 185, 193, 285/64; 241/33, 36; 277/510, 314, 312, 277/626, 644

See application file for complete search history.

(56) References Cited

U.S. PATENT DOCUMENTS

| | | | | | |
|---|---|---|---|---|---|
| 538,301 | A | | 4/1895 | Vanderman | |
| 1,020,929 | A | | 3/1912 | Row | |
| 1,059,748 | A | | 4/1913 | Mueller et al. | |
| 1,772,537 | A | * | 8/1930 | Cox | 285/323 |
| 1,811,827 | A | | 6/1931 | Brotz | |
| 2,063,632 | A | | 12/1936 | Schneider | |
| 2,069,177 | A | * | 1/1937 | Craver | 277/626 |
| 2,100,796 | A | * | 11/1937 | Church | 285/340 |
| 2,282,212 | A | * | 5/1942 | Pope | 4/692 |
| 2,349,202 | A | | 5/1944 | Slezak | |
| 2,350,017 | A | * | 5/1944 | Davis | 285/342 |
| 2,464,332 | A | | 3/1949 | Maund et al. | |
| 2,672,205 | A | | 3/1954 | McDonald | |
| 2,855,003 | A | | 10/1958 | Thaxton | |
| 3,104,400 | A | | 9/1963 | Lantz et al. | |
| 3,150,889 | A | | 9/1964 | Watts | |
| 3,397,902 | A | | 8/1968 | Dutcher | |
| 3,430,990 | A | | 3/1969 | Nelson | |
| 3,495,280 | A | * | 2/1970 | Galbiati | 4/679 |
| 3,795,924 | A | | 3/1974 | Kempler | |
| D244,533 | S | | 5/1977 | Eidelberg et al. | |
| 4,182,519 | A | | 1/1980 | Wilson | |
| 4,380,834 | A | | 4/1983 | Wentz | |
| 4,627,644 | A | * | 12/1986 | Ekman | 285/3 |
| 4,694,513 | A | | 9/1987 | Kiziah | |
| 5,498,036 | A | * | 3/1996 | Kingsford | 285/123.1 |
| 5,516,159 | A | * | 5/1996 | Hirakawa et al. | 285/388 |
| 5,749,105 | A | | 5/1998 | Bruno et al. | |
| 5,791,693 | A | * | 8/1998 | Crawford | 285/23 |
| 5,832,544 | A | | 11/1998 | Pan | |
| 5,882,043 | A | | 3/1999 | Murphy et al. | |
| 5,946,746 | A | | 9/1999 | Bloom | |

(Continued)

*Primary Examiner*—John K Fristoe, Jr.
*Assistant Examiner*—Marina Tietjen
(74) *Attorney, Agent, or Firm*—McDermott Will & Emery LLP

(57) ABSTRACT

A pop-up valve, comprising an internally threaded screw nut, and positioned in a circumjacent manner around a cylindrical waste drain pipe. A complementary, externally threaded screw bolt, is threadably engageable with the screw nut, and also circumjacent the cylindrical waste drain pipe. A seal element is positioned on the screw nut, and is vertically movable towards the bottom of a sink, as a result of corresponding vertical movement of the screw bolt.

24 Claims, 3 Drawing Sheets

U.S. PATENT DOCUMENTS 6,219,861 B1 4/2001 Chen
6,361,084 B1 * 3/2002 Zarbo ..... 285/341
6,484,330 B2 11/2002 Gray et al.
6,725,472 B2 4/2004 Gray et al.
6,763,533 B2 7/2004 Mayer et al.
2004/0251635 A1 * 12/2004 Ishida ..... 277/510

* cited by examiner

POP-UP VALVE WITH SEAL

TECHNICAL FIELD

The invention relates to pop-up valves or plungers for selectively opening and closing an access to a generally cylindrical waste drain pipe.

BACKGROUND OF THE INVENTION

Pop-up valves for selectively opening and closing access to a generally cylindrical waste drain pipe, for example in a bathroom lavatory or sink, are well-known in the art. An example of one such pop-up valve is shown in U.S. Pat. No. 4,380,834.

Typically, the structures making up prior art pop-up valves are placed upon or adjacent a cylindrical waste drain pipe. In one type of prior art pop-up valve, as may best be seen in FIG. 6, the cylindrical waste drain pipe is externally threaded. An internally threaded nut is rotatably secured to the external threads of the cylindrical waste drain pipe.

As the nut is turned in a clockwise or counterclockwise direction, it moves vertically upwardly and downwardly relative to the drain pipe. A rubber seal is positioned at the top of this nut. Accordingly, as the nut is moved upwardly, it urges the adjacent rubber seal element upwardly.

This vertical movement is necessary so that a given pop-up valve can be installed under, and can accommodate, sinks of different styles, sizes, and configurations.

The engagement of this black rubber seal element with the bottom of the sink prevents leakage of water through the floor or base of the sink.

In contrast, as the nut is moved downwardly, it permits the lowering of the rubber seal element away from the underside of the sink, as for example to facilitate replacement of a worn rubber seal.

Certain deficiencies arise from the structure of the above-described prior art pop-up valves. For example, as new rubber seals are moved upwardly towards the bottom of the sink, the inner surfaces of those seals slide and rub against the threads of the drain pipe. Friction results from the sliding of the rubber seal against these threads. This friction makes it more difficult to move the rubber seal upwardly and into position against the bottom of the sink.

However, a more serious problem results from the upward vertical movement of the rubber seal. Particularly, the portion of the rubber seal that abuts against the threads along the exterior of the drain pipe can be damaged as a result of the upward movement relative to, and upon, those threads. Such damage can compromise the ability of the rubber seal to create a water-tight condition at the bottom of the sink.

Other generally relevant prior art includes U.S. Pat. Nos. Des. 244,533; 5,749,105; 5,832,544; 5,946,746; 6,219,861; 6,484,330; 6,725,472; 6,763,533; 3,397,902; 538,301; 4,694,513; 3,795,924; 3,430,990; 3,104,400; 2,672,205; 2,464,332; 2,063,632; 1,811,827; 5,882,043; 4,182,519; 3,150,889; 2,855,003; 2,349,202; 1,059,748; and 1,020,929.

The present invention is provided to solve the problems discussed above and other problems, and to provide advantages and aspects not provided by prior pop-up valves and valve bodies of this type. A full discussion of the features and advantages of the present invention is deferred to the following detailed description, which proceeds with reference to the accompanying drawings.

SUMMARY OF THE INVENTION

The invention is a pop-up valve. This pop-up valve includes an adjustable, internally threaded screw nut. The pop-up valve further includes a complementary, externally threaded screw bolt. Both the screw nut and screw bolt are preferably sleeves that are circumjacent a generally cylindrical drain waste pipe.

As the screw nut is moved in one direction, for example, a clockwise direction, it is threadably engaged with, and causes movement in an opposite direction, of the screw bolt. For example, as the screw nut is moved in the clockwise direction, it causes movement of the screw bolt in the counterclockwise direction.

As that screw nut is rotated in a clockwise direction, downward movement of the screw nut is prevented by contact between the bottom of that screw nut and the top of a stationary base plate.

While vertical movement of the screw nut is impeded by the base plate, relative rotating movement of the screw nut and screw bolt causes or effects vertical movement of the screw bolt. Particularly, as a result of the construction of the elements of the invention, as the screw nut is turned in a clockwise direction, the screw bolt moves upwardly. The top of the screw bolt in turn urges the rubber seal element upwardly, and towards the base of the sink.

In contrast, as the screw nut is turned in a counterclockwise direction, the screw bolt can move downwardly. The lowering of the screw bolt in turn permits downward movement of the rubber seal, away from the sink.

Unlike the units of the prior art, such as that shown in FIG. 6, as the rubber seal element is in this way moved upwardly towards the bottom of the sink, that rubber seal element does not contact threads on the drain pipe portion of the valve. This is because all of the threads of this new pop-up valve are on either the screw nut or the screw bolt. There are no threads on the smooth drain pipe, upon which the rubber seal element slides.

Accordingly, the valve has no threads that could damage the rubber seal. This in turn lowers the risk of leakage resulting from a damaged rubber seal. In addition, the rubber seal element moves along the smooth drain pipe with less friction, as compared to the friction caused by movement of the rubber seal along the threaded drain pipe of the prior art unit of FIG. 6.

A further aspect of the invention relates to the shape and profile of the rubber seal element. The rubber seal element of the invention has a slimmer profile, and a generally trapezoidal cross-section.

Another way to describe this cross-section is that it is comprised of at least four walls. The first wall is generally vertical, and abuts against the drain pipe. The second wall is generally horizontal. The third and fourth walls are both positioned at an acute angle, relative to the second, horizontal wall.

Preferably, as may best be seen in cross-section, the third and fourth walls are longer than either the first or second walls.

It is further preferable that the third and fourth walls are disposed, relative to each other, at an acute angle.

This shape enhances the ability of this new seal to prevent leakage, when that seal is positioned snugly against the bottom of a sink. This shape is also believed to reduce the likelihood of damage to the seal, when that seal is positioned snugly against the bottom of the sink.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1A:
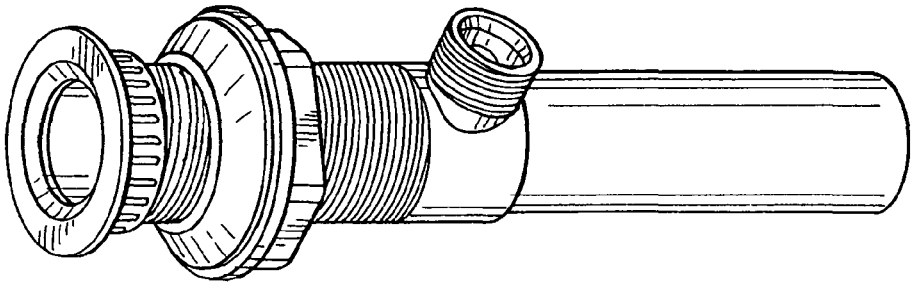
FIG.1A PRIOR ART
FIG. 1A is a perspective view of a prior art pop-up valve.

While this invention is susceptible of embodiments in many different forms, there is shown in the drawings and will be described in this application, in detail, preferred embodiments of the invention. The present disclosure is to be considered as an example of the principles of the invention. This disclosure is not intended to limit the broad aspect of the invention to the illustrated embodiments.

Figure 1:
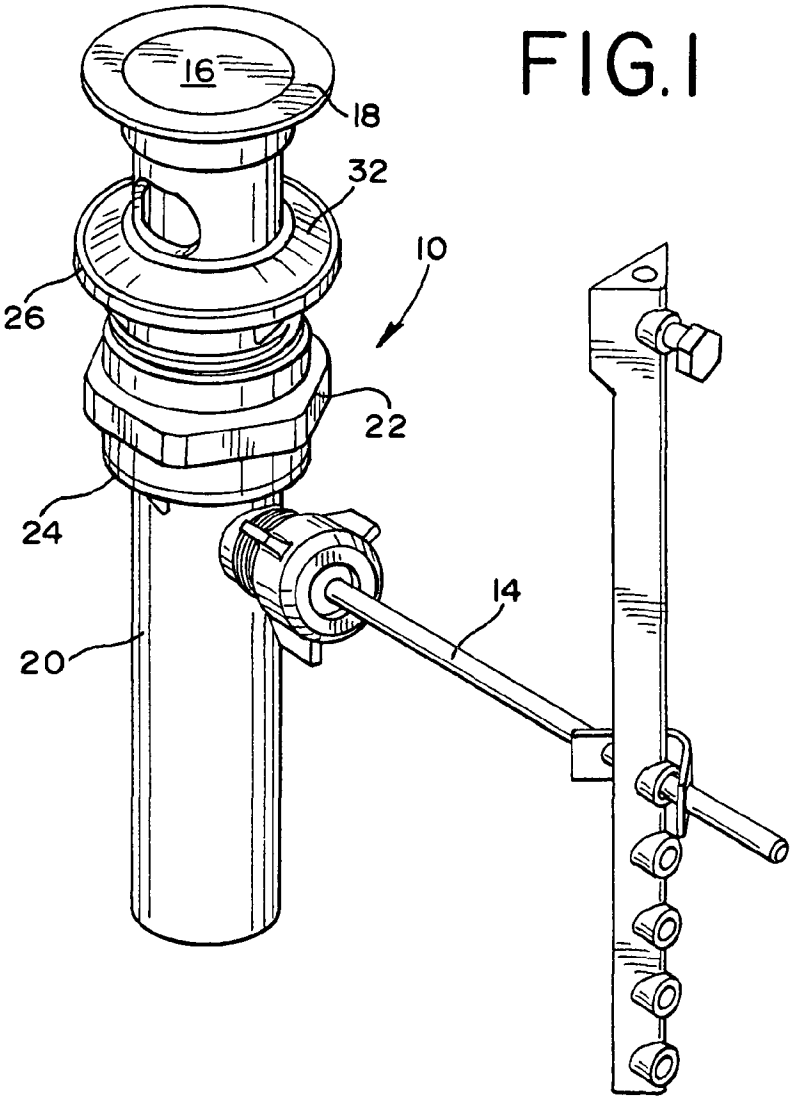
FIG. 1 is a perspective view of a waste drain system in accordance with the invention.
Figure 2:
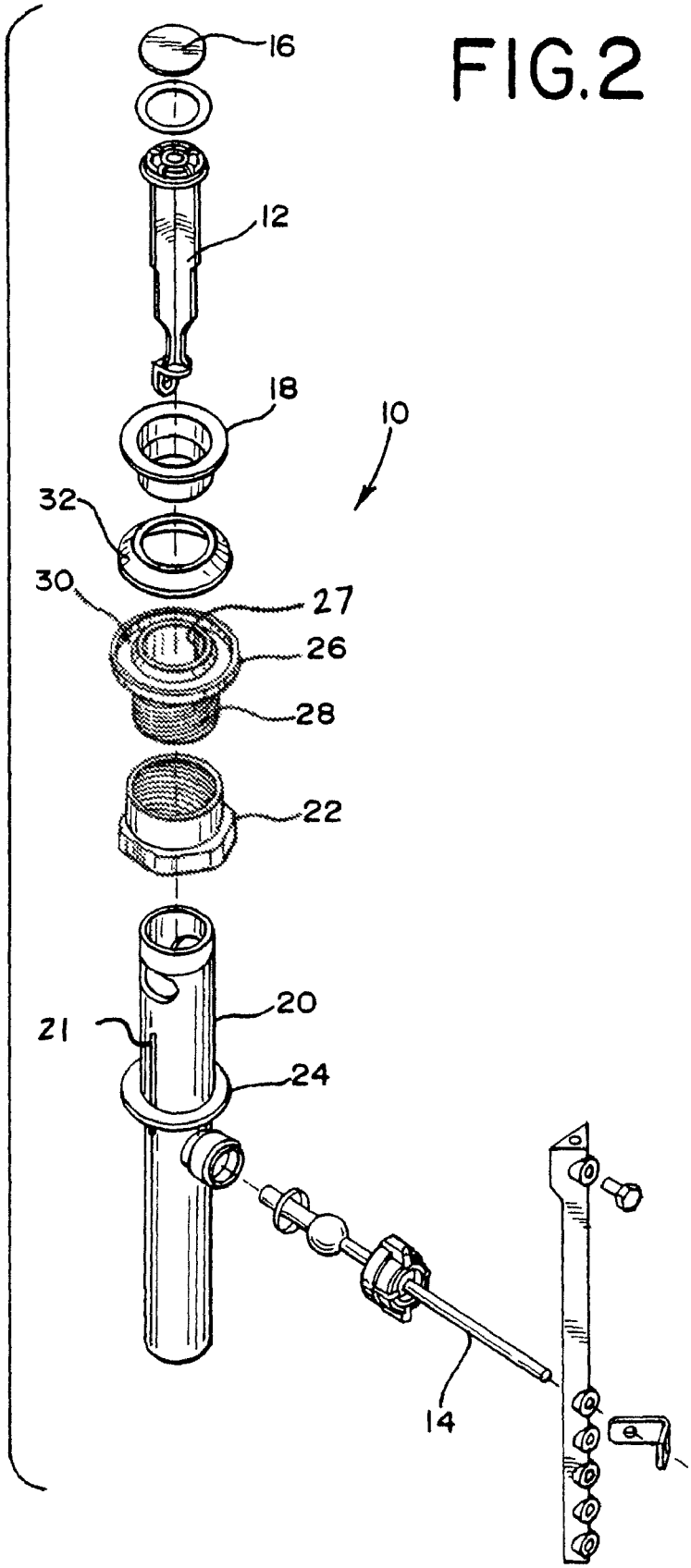
FIG. 2 is an exploded view of the waste drain system of FIG. 1.

As may best be seen in FIGS. 1 and 2, the invention is a waste drain system, which comprises a pop-up valve 10. Valves of this kind alternatively open and close access to the generally cylindrical waste drain pipe, for example, the cylindrical waste drain pipe positioned below a bathroom lavatory or sink.

The pop-up valve 10 includes pop-up plunger 12. This plunger 12 is movable upwardly and downwardly by means of the pivotal movement of an actuator 14. The system also includes a head portion 16 at the top of the movable plunger 12, and a stationary annular seat 18 that is disposed at the upwardly-facing bottom portion of a sink.

When the plunger 12 is moved downwardly by the actuator 14, the head portion 16 of the valve 10 engages and creates a generally water-tight seal with the annular seat 18.

In contrast, when the plunger 12 is moved upwardly by the actuator 14, the head portion 16 of the valve 10 moves away from and disengages the annular seat 18. This disengagement permits any water or other liquid in the sink to be discharged through the cylindrical waste drain pipe 20.

In this embodiment, the valve 10 may include an adjustable, internally threaded screw nut 22. Here, this screw nut 22 is closely fitted over the cylindrical waste drain pipe 20, but loosely enough such that it may be moved vertically upwards and downwards relative to the waste drain pipe 20.

As will be explained below, however, it is generally preferable that during operation of the invention, the screw nut 22 remain relatively stationary, i.e., that the screw nut 22 move vertically only a relatively small distance upwardly and downwardly upon the waste drain pipe 20.

To prevent the screw nut 22 from moving below a predesignated point, a flange-like, stationary base plate 24 is fixedly secured or integrally formed with the cylindrical waste drain pipe 20. As shown in FIG. 2, the waste drain pipe 20 includes an external longitudinal rail 21 that extends upward from the base plate 24 and that is received by an internal longitudinal channel 27 of the screw bolt 26 during sliding movement of bolt 26 along the drain pipe 20. As may best be seen in FIGS. 1 and 2, downward movement of the screw nut 22 beyond that pre-designated point is prevented by contact between the bottom of the screw nut 22 and the top of the stationary base plate 24.

The screw nut 22 may be freely rotated in either a clockwise or a counterclockwise direction. When the screw nut 22 is rotated in this manner, the threads of the screw nut 22 are engageable with, and thereby cause movement of, an externally threaded screw bolt 26. The external threads 28 of this screw bolt 26 are complementarily threaded to the internal threads of the screw nut 22.

Particularly, as the screw nut 22 is rotated in one direction, for example, in a clockwise direction, it is threadably engaged with, and causes movement in an opposite, counterclockwise direction, of the screw bolt 26.

As indicated above, and as may best be seen in FIGS. 1 and 2, vertical, downward movement of the screw nut 22 is impeded or limited by the stationary base plate 24. Accordingly, as that screw nut 22 is rotated in a clockwise direction, the internal threads of that screw nut 22 engage the external threads 28 of the screw bolt 26. This causes counterclockwise rotation of the screw bolt 26. Because the screw nut 22 cannot move below the base plate 24, continued rotation of the screw nut 22 will ultimately cause the screw bolt 26 to move upwardly.

In summary, as a result of the clockwise rotation of the screw nut 22, the screw bolt 26 is caused to move upwardly along the external longitudinal rail 21, and towards the underside of the adjacent sink.

The top of the screw bolt 26 includes a groove 30 that is sized and shaped in a manner to accommodate a seal element 32. In this case, the seal element 32 is most preferably made of rubber or another similar elastomer. The most preferred material for the seal element 32 is EPDM, which is an acronym for ethylene propylene diene terpolymer rubber. As the screw bolt 26 is caused to move upwardly, as described above, the rubber seal element 32 is caused to move towards and into engagement with the bottom of the sink. In this way, the rubber seal element 32 helps to prevent leakage of water from the bottom of the sink.

If clockwise rotation of the screw nut 22 causes the screw bolt 26 to move upwardly, then counterclockwise rotation of the screw nut 22 causes the screw bolt 26 to move downwardly. As the screw bolt 26 is caused to move downwardly, the rubber seal element 32 is lowered and moved away from and out of engagement with the bottom of the sink. When lowered away from the sink in this manner, the damaged rubber seal element 32 can be removed from its location within a groove 30 at the top of the screw bolt 26 that accommodates the rubber seal element 32. As a result, the old, damaged rubber seal element 32 may then be replaced with a new rubber seal element 32.

The current invention has significant advantages over typical prior art constructions. In one of the prior art constructions, as shown in FIG. 6, the upwardly and downwardly moving seal elements abut against threads disposed along the exterior of the drain pipe.

In contrast, in the present invention, as may be seen in FIGS. 1 and 2, the cylindrical waste drain pipe 20 need not have threads on its exterior. The threads that facilitate the raising and lowering of the rubber 32 seal towards and away from the bottom of the sink are all contained within the screw nut 22 and the screw bolt 26. The rubber seal element 32 is positioned at the top of, and is raised and lowered by, the screw bolt 26.

As a result, as the rubber seal element 32 of the invention is slidably raised and lowered along and relative to the drain waste pipe 20, there are no threads on the outside of that drain waste pipe 20 that could damage the rubber seal element 32, as that seal element 32 is raised and lowered.

Accordingly, the possibility of both damage to the rubber seal element 32 of the invention, and of the leaks that are a consequence of that damage, are lowered.

In the preferred embodiment, the relationship of the screw nut 22 and the screw bolt 26 may best be described as "circumjacent." For the purposes of this specification, "circumjacent" means that the screw nut 22 and the screw bolt 26 are closely adjacent to the cylindrical waste drain pipe 20, but are spaced far enough away from that drain pipe 20 so as to permit the screw nut 22 and screw bolt 26 to be moved freely upwards and downwards, relative to the drain pipe 20. To effect this, for example, the internal diameter of the screw nut 22 and the internal diameter of the screw bolt 26 are both somewhat larger than the external diameter of the generally cylindrical waste drain pipe 20. Thus, both the screw nut 22 and the screw bolt 26 are somewhat like a loose fitting sleeve, surrounding but closely adjacent to the generally cylindrical waste drain pipe 20.

In summary, the pop-up valve of the invention eliminates threads along which a rubber seal could slide and be damaged. This in turn lowers the risk of leakage resulting from a damaged rubber seal element. In addition, the rubber seal element 32 moves along the smooth drain pipe with less friction, as compared to the friction caused by movement of the rubber seal element along the threaded drain pipe of many prior art units.

Figure 3:
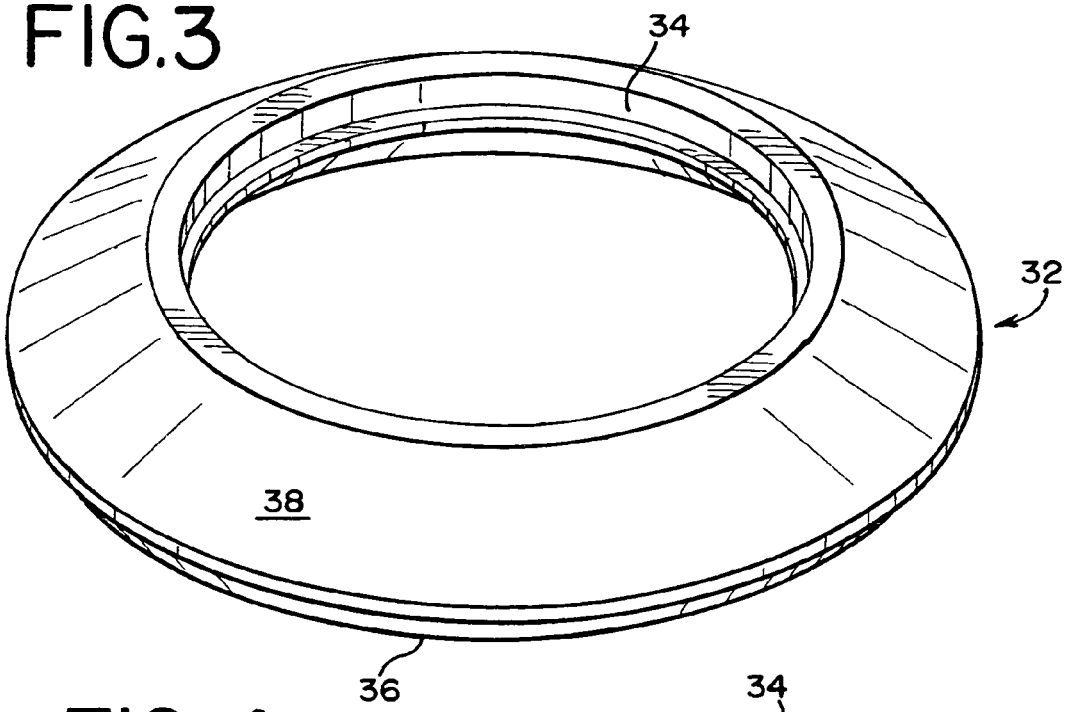
FIG. 3 is a perspective view of the elastomeric seal element of the invention.
Figure 4:
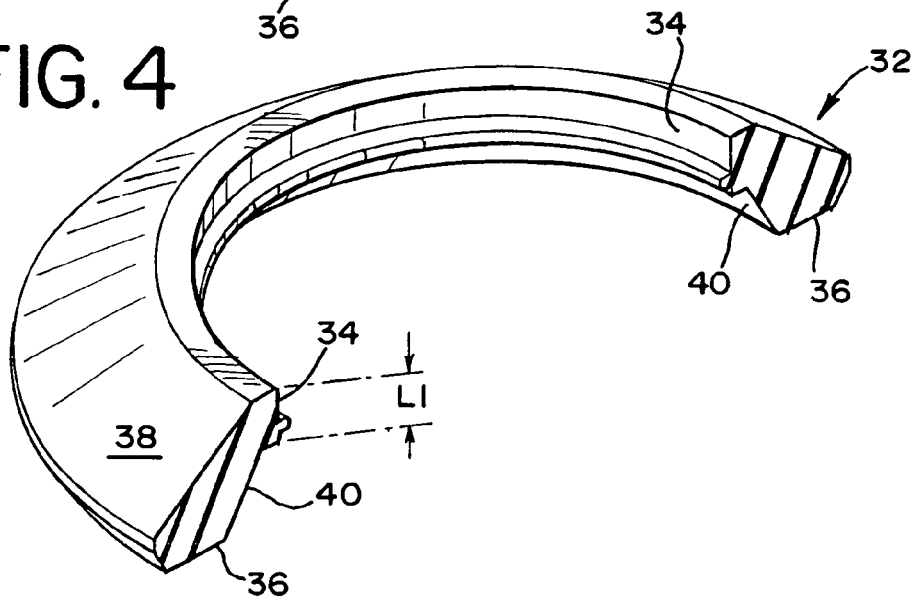
FIG. 4 is a cutaway view of a portion of the elastomeric seal element of FIG. 3.

A further aspect of the invention relates to the shape and profile of the rubber seal element 32. The rubber seal element 32 is shown in detail in FIGS. 3-5. The rubber seal element 32 of the invention has a slimmer profile.

Perspective and cross-sectional views of the present invention show this distinct shape. As may best be seen in FIG. 5, the rubber seal element 32 is comprised of at least four major, defining walls, and several additional or auxiliary walls.

It should be understood that the seal element 32 in accordance with the invention may have walls in excess of four walls, as long as the seal element includes at least the four major walls, as described below.

The four major walls include a first wall 34. First wall 34 is generally vertical, and in use, abuts against the cylindrical waste drain pipe 20. This first wall 34 is the wall 34 which makes direct contact with the drain pipe 20, and makes up the "inner rim" of the rubber seal element 32.

The second wall 36 is generally horizontal. This horizontal wall 36 anchors the rubber seal element 32 within the groove 30 that is at the top of the screw bolt 26.

Figure 5:
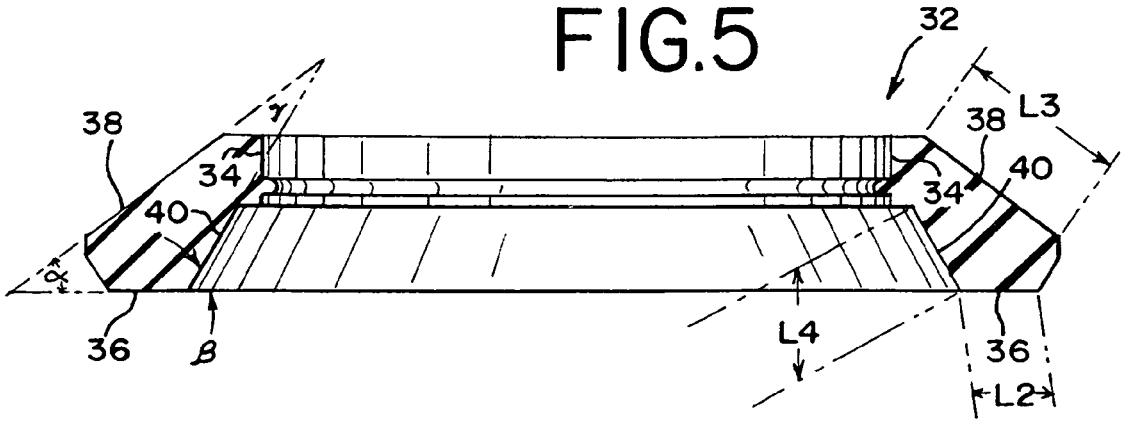
FIG. 5 is a cross-sectional view of the elastomeric seal element of FIG. 3.

As may best be seen in FIG. 5, the third 38 and fourth walls 40 are both positioned at an acute angle relative to the second, horizontal wall 36. One example of an acceptable acute angle $\alpha$ and $\beta$ at which the third 38 and fourth walls 40, respectively, are positioned relative to the second, horizontal wall 36 is shown in FIG. 5. In this preferred embodiment, the angle $\alpha$ is 36.9 degrees, and the angle $\beta$ is 59.5 degrees. The orientation of these walls 38 and 40 provide the rubber seal element 32 with a slim, narrow cross-section.

Preferably, as may best be seen in the cross-section of FIG. 5, the third 38 and fourth walls 40 are both longer than either the first 34 or second walls 36. As may be seen in FIGS. 4 and 5, the lengths of the first 34, second 36, third 38, and fourth 40 walls are depicted as L1, L2, L3, and L4, respectively.

It is further preferable that the third 38 and fourth walls 40 are disposed at an acute angle, relative to each other. One suitable acute angle $\gamma$ is shown in FIG. 5. In this preferred embodiment, the angle $\gamma$ is 22.7 degrees.

This particular shape is believed to enhance the ability of this new seal element 32 to prevent leakage, when that seal element 32 is in its final position, i.e., fitted snugly against the bottom of a sink. This shape is also believed to reduce the likelihood of damage to the seal element 32, when that seal element 32 is moved upwardly, and first contacts the bottom of the sink. Finally, the shape of the seal element 32 is also believed to reduce the likelihood of damage, as that seal element 32 is moved vertically along the cylindrical waste drain pipe 20.

The enhanced ability for this new seal element 32 to prevent leakage is believed to result from the relative rigidity of three of the four major walls, and the relative flexibility of the fourth of the four major walls, when that seal element 32 is placed into contact with the bottom of a sink.

Particularly, the entire second wall 36, and the bottom of the fourth wall 40, are captured in the groove 30 at the top of the screw bolt 26. This contact of these walls 36 and 40 with this groove 30 is believed to have a rigidifying effect on the second wall 36 and the fourth wall 40.

The third wall 38 "presses" firmly against the bottom of the sink, when the seal element 32 is in position adjacent that sink. Again, this contact with the bottom of the sink is believed to have a rigidifying effect on the third wall 38.

Of the four major walls 34, 36, 38, and 40, the first wall 34 is the one wall that is believed to retain some flexibility. Even while the other walls 36, 38 and 40 have a degree of rigidity when in place against the bottom of a sink, the first wall 34 is relatively movable, so as to enable it to conform to the shape of the cylindrical waste drain pipe 20. In this way, the contact of the first wall 34 with the exterior walls of the cylindrical waste drain pipe 20 further helps to avoid, or at least to reduce the possibility of, leaks.

In summary, the particular construction of the novel seal element 32 of the invention permits the wall 34 to have a degree of flexibility, giving that wall 34 a tendency to conform to the shape of the abutting cylindrical waste drain pipe 20.

While the specific embodiments have been illustrated and described, numerous modifications come to mind without significantly departing from the spirit of the invention, and the scope of protection is only limited by the scope of the accompanying claims.

What is claimed is:

1. A pop-up valve assembly for use with a bathroom sink, comprising an internally threaded screw nut for circumscribing a unitary cylindrical waste drain pipe that is devoid of external threads;

a sink seat secured to an upper end of said waste drain pipe;

an elongated plunger extending through said sink seat and into an upper portion of said waste drain pipe;

a complementary, externally threaded screw bolt, threadably engageable with the screw nut; and a seal element that is vertically movable, as a result of corresponding continual sliding movement of the screw bolt along an external longitudinal rail of said waste drain pipe.

2. The pop-up valve of claim 1, wherein when the screw nut is rotated in one rotational direction, the screw bolt is rotated in an opposite rotational direction.

3. The pop-up valve of claim 1, wherein when the screw nut is moved in a clockwise direction, the screw bolt is moved in a counterclockwise direction.

4. The pop-up valve of claim 1, further comprising a stationary base plate secured to the cylindrical waste drain pipe at a lower edge of the longitudinal rail, said stationary base plate limiting downward sliding movement of the screw nut along said waste drain pipe.

5. The pop-up valve of claim 4, wherein the screw bolt is upwardly movable, to urge the seal upwardly.

6. The pop-up valve of claim 4, wherein the screw bolt is downwardly movable, to permit the seal to move downwardly.

7. The pop-up valve of claim 1, wherein the seal element is made of an elastomeric material, and wherein the seal element is upwardly and downwardly movable along the generally cylindrical waste pipe.

8. The pop-up valve of claim 7, wherein the elastomeric seal element has a generally trapezoidal cross-section.

9. The pop-up valve of claim 7, wherein the elastomeric seal has a first, generally vertical wall; a second, generally horizontal wall; a third wall positioned at an acute angle relative to the second, horizontal wall; and a fourth wall, also positioned at an acute angle relative to the second horizontal wall.

10. The pop-up valve of claim 9, wherein each of the first and second walls are shorter than each of the third and fourth walls.

11. The pop-up valve of claim 9, wherein the third and fourth walls are disposed, relative to each other, at an acute angle.

12. A pop-up valve assembly for use with a bathroom sink, comprising:

an internally threaded screw nut is a sleeve that is circumjacent a unitary, generally cylindrical waste drain pipe that is devoid of external threads, wherein said waste drain pipe includes an external longitudinal rail;

a sink seat secured to an upper end of said waste drain pipe, wherein an upper portion of said waste drainpipe receives an elongated plunger;

a complementary, externally threaded screw bolt, threadably engageable with the screw nut; and a seal element that is contained within a groove at the top of the screw bolt, and is slidingly movable, as a result of corresponding continual sliding movement of the screw bolt along said longitudinal rail of said waste drain pipe.

13. The pop-up valve of claim 12, wherein the externally threaded screw bolt includes a longitudinal channel that receives said longitudinal rail during sliding movement of said screw bolt.

14. The pop-up valve of claim 13, wherein said screw bolt is positioned radially outward of said drain pipe, and said screw nut is positioned radially outward of said screw bolt.

15. A pop-up valve assembly for use with a bathroom sink, comprising:

an elongated cylindrical waste drain pipe that is devoid of external threads and that includes an external longitudinal rail;

an elongated plunger that extends through a sink seat and into an upper portion of the waste drain pipe;

an internally threaded screw nut that circumscribes the waste drain pipe;

a complementary screw bolt with external threads that engage the internal threads of the screw nut, said screw bolt continually slidable along said longitudinal rail of said waste drain pipe; and a seal element that is vertically movable, as a result of corresponding sliding movement of both the screw nut and screw bolt along said waste drain pipe.

16. The pop-up valve assembly of claim 15, further comprising a plunger that extends through the screw nut and the screw bolt and into the waste drain pipe.

17. The pop-up valve of claim 15, further comprising a stationary base plate extending radially outward from outer surface of the cylindrical waste drain pipe, said stationary base plate limiting downward sliding movement of the screw nut along said waste drain pipe.

18. The pop-up valve assembly of claim 15, wherein the elastomeric seal resides within an annular groove of the screw bolt, and wherein the elastomeric seal has a first, generally vertical wall; a second, generally horizontal wall; a third wall positioned at an acute angle relative to the second, horizontal wall; and a fourth wall, also positioned at an acute angle relative to the second horizontal wall.

19. The pop-up valve assembly of claim 15, further comprising a seat coupled to the upper end of the waste drain pipe, wherein the seat engages a portion of a sink when the pop-up valve assembly is installed.

20. A pop-up valve assembly for use with a bathroom sink, comprising:

an elongated cylindrical waste drain pipe that is devoid of external threads, the waste drain pipe includes an external longitudinal rail and a stationary base plate, said base plate extending radially outward from the waste drain pipe at a lower edge of the longitudinal rail;

a sink seat secured to an upper end of said waste drain pipe;

a screw bolt circumjacent the waste drain pipe, said screw bolt having an upper annular groove with a seal element, wherein said screw bolt is continually slidable along said longitudinal rail of said waste drain pipe;

a screw nut circumjacent said screw bolt, said screw nut having internal threads that engage external threads of said screw bolt.

21. The pop-up valve assembly of claim 20, further comprising an elongated plunger extending through said sink seat and into an upper portion of said waste drain pipe.

22. The pop-up valve assembly of claim 21, further comprising an actuator assembly operably coupled to said plunger for actuation of said plunger within said waste drain pipe.

23. The pop-up valve assembly of claim 20, wherein said base plate is integrally formed with said waste drain pipe.

24. The pop-up valve assembly of claim 20, wherein said screw bolt includes a longitudinal channel that receives said longitudinal rail during sliding movement of said screw bolt.

* * * * *